US008955749B2

(12) United States Patent
Elefante

(10) Patent No.: US 8,955,749 B2
(45) Date of Patent: Feb. 17, 2015

(54) AIMING SYSTEM

(71) Applicant: Selex ES S.p.A., Rome (IT)

(72) Inventor: Alessandro Elefante, Florence (IT)

(73) Assignee: Selex ES S.p.A., Rome (IT)

( * ) Notice: Subject to any disclaimer, the term of this patent is extended or adjusted under 35 U.S.C. 154(b) by 0 days.

(21) Appl. No.: 14/363,017

(22) PCT Filed: Dec. 7, 2012

(86) PCT No.: PCT/EP2012/074831

§ 371 (c)(1),
(2) Date: Jun. 5, 2014

(87) PCT Pub. No.: WO2013/083796

PCT Pub. Date: Jun. 13, 2013

(65) Prior Publication Data

US 2014/0319217 A1 Oct. 30, 2014

(30) Foreign Application Priority Data

Dec. 9, 2011 (IT) ..... FI2011A0266

(51) Int. Cl.
*G06F 19/00* (2011.01)
*F41G 3/16* (2006.01)

(52) U.S. Cl.
CPC ..... *F41G 3/165* (2013.01)
USPC ..... 235/407; 235/404; 235/409; 348/158; 340/980

(58) Field of Classification Search
USPC ..... 235/407, 404, 409; 340/980; 348/158
See application file for complete search history.

(56) References Cited

U.S. PATENT DOCUMENTS

| | | | | |
|---|---|---|---|---|
| 5,138,555 | A * | 8/1992 | Albrecht | 701/14 |
| 5,353,134 | A | 10/1994 | Michel et al. | |
| 5,806,229 | A | 9/1998 | Daz et al. | |
| 6,202,535 | B1 | 3/2001 | Alhadef et al. | |
| 6,662,370 | B1 * | 12/2003 | Buchanan, Jr. | 2/6.2 |
| 8,336,777 | B1 * | 12/2012 | Pantuso et al. | 235/409 |
| 2008/0204361 | A1 | 8/2008 | Scales et al. | |
| 2009/0040308 | A1 * | 2/2009 | Temovskiy | 348/158 |
| 2009/0218884 | A1 * | 9/2009 | Soar | 307/11 |
| 2011/0079703 | A1 * | 4/2011 | Gunning et al. | 250/206.2 |
| 2014/0152792 | A1 * | 6/2014 | Krueger | 348/78 |

FOREIGN PATENT DOCUMENTS

| | | | |
|---|---|---|---|
| DE | 202009012199 | U1 | 4/2010 |
| EP | 0 543 718 | A1 | 5/1993 |
| FR | 2 758 625 | A1 | 7/1998 |
| WO | 2008/089203 | A1 | 7/2008 |

* cited by examiner

*Primary Examiner* — Allyson Trail
(74) *Attorney, Agent, or Firm* — McGlew and Tuttle, P.C.

(57) ABSTRACT

An aiming system for portable weapons comprising pairs of inertial sensors of gyroscopic, accelerometer and magnetometric type arranged respectively on a weapon and on an helmet with Head Up Display, so as to determine both the relative orientation and the relative position in space of the weapon and of the helmet, with consequent display of the line of fire on the Head Up Display.

23 Claims, 3 Drawing Sheets

AIMING SYSTEM

TECHNICAL FIELD

The present invention relates to the field of portable weapons, and more in particular relates to an aiming system for portable weapons.

STATE OF THE ART

As it is known, in order to attain accurate aiming, conventional aiming systems of portable weapons oblige the user to use display apparatus constrained to the weapon. Both in the standard mechanical aiming system, for which two references are collimated along the axis of the barrel, and in advanced systems that use optical paths, IR sensors and other types of device, it is in fact necessary to place the eye, and therefore the face, in proximity of an eyepiece integral with the weapon.

To perform this operation effectively, it is not possible to provide complete protection of the face, which therefore remains exposed, in the case of warfare, to enemy fire.

An example of a partial solution to the problems set forth above is described in the utility model patent application DE202009012199. This document describes a portable weapon equipped with a system the makes it possible to perform aiming operations by means of a helmet equipped with a visor placed in front of the eyes onto which an aiming reticle is dynamically projected.

To ensure that the line of fire of the weapon appears on this reticle, an electronic unit positioned on the helmet calculates the relative angular displacement between two sets of inertial sensors mounted on helmet and weapon respectively, which identify the relative movements of helmet and weapon, and moves the aiming reticle accordingly. In particular, to adjust the orientation in space of the weapon, a circular movement sensor (gyroscope) is arranged thereon.

The helmet is also provided with a gyroscope adapted to trace the angular movements thereof. Both weapon and helmet must be oriented by a magnetic compass (magnetic sensors that determine a fixed orientation in space) and aligned with each other. After having "put on" the system, the shooter must align the weapon with the aiming point of the visor to "calibrate" the system.

This type of improved portable weapon moves in the direction of facilitating the aiming step, as it indirectly results in a limitation of the user's exposure to enemy fire, as it is no longer necessary to place the head in alignment with an aiming system. However, it has considerable practical limits, due substantially to an intrinsic lack of precision in the most "delicate" moments, i.e. those in which the head of the user is positioned at a distance from the weapon.

In fact, it must be noted how this system performs motion relations between weapon and helmet by means of angular coordinates: the user of the weapon is able to align the weapon with the line of sight without having to necessarily position the head (or the eyes) precisely with respect to the line of sight, but is unable to eliminate the error due to a translational motion, i.e. linear and not angular, of the weapon with respect to the helmet (i.e. the parallax error), i.e. with respect to the calibration position.

In some circumstances this limitation makes the aiming system completely useless, for example:

- if the user is inside an armored vehicle, in order to shoot he/she is obliged to look forward, so as to remain protected, but the weapon must be pointed out of the window;

- if the user is taking cover behind an obstacle, he/she is still obliged to peep out (to the smallest extent possible) to be able to view the target, but in order to shoot he/she must necessarily hold the weapon either above the head or at the side;
- if the user is moving forward holding the weapon at shoulder height to be able to move as fast as possible and is surprised by a sudden threat, the shooting action will be carried out with the weapon in this position, i.e. translated from the calibration position.

In all these circumstances, the parallax error due to displacement of the line of fire (for example the line of continuation of the barrel of the rifle in which the system is implemented) with respect to the line of sight (parallel to each other) cannot be detected and can easily exceed half a meter on a target at one hundred meters, a value that is unacceptable in the specifications of combat weapons.

Moreover, it is important to note that the gyroscopic sensors (i.e. circular motion sensors) are subject to an intrinsic error called "drift" (a phenomenon for which, even with the sensor stopped, a non-null angular velocity is measured) which causes further inaccuracies in the aim. To limit this drift error to a minimum, it is necessary to use high quality gyroscopes, which naturally increases the costs of the weapon.

OBJECT AND SUMMARY OF THE INVENTION

The object of the present invention is to solve the problems indicated in prior art portable weapons and in particular to develop an aiming system for portable weapons that is able to prevent exposure of the user during the aiming step, while at the same time maintaining a high aiming precision.

Another important object of the present invention is to develop an aiming system for portable weapon which is inexpensive, while also ensuring high precision.

These and other objects, which will be more apparent below, are achieved with an aiming system for portable weapon according to the appended claim 1.

BRIEF DESCRIPTION OF THE DRAWINGS

Further characteristics and advantages of the invention will be more apparent from the description of a preferred but non-exclusive embodiment thereof, illustrated by way of non-limiting example in the accompanying drawings, wherein.

DETAILED DESCRIPTION OF AN EMBODIMENT OF THE INVENTION

Figure 1:
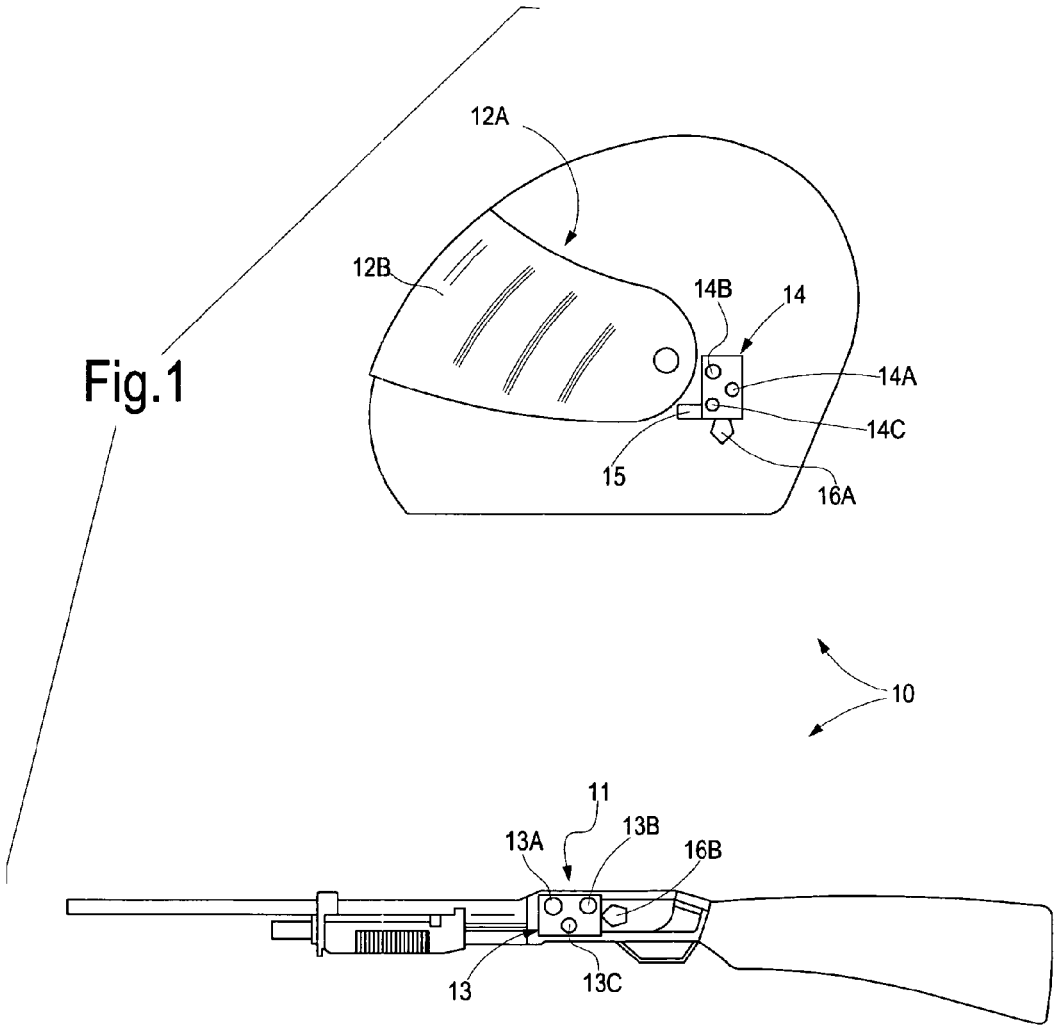
FIG. 1 represents a diagram of the portable weapon according to the invention.

With reference to the aforesaid figures, an aiming system for portable weapons according to the invention is indicated as a whole with the number 10. The number 11 indicates a portable weapon that can be used with the aiming system of the invention, for example an assault rifle, while 12 indicates a display device that can be worn by the user, in this example in the form of a helmet with a Head Up Display 12A (hereinafter also indicated with HUD, for brevity). This head up display 12A defines a visor 12B for the helmet, which also has a protective function for the user.

The system comprises a first pair of inertial sensors 13B-14B adapted to detect respective orientations in space and/or relative orientations of the weapon and of the display device on which they are constrained, a second pair of inertial sensors 13A-14A adapted to detect the orientation of the magnetic field with respect to the weapon and to the display device on which they are constrained, and a third pair of inertial sensors 13C-14C adapted to detect linear displacements and therefore absolute or relative positions in space for the respective weapon bodies and of the display device on which they are constrained.

Preferably, more in particular, mounted on the portable weapon 11 is a first inertial platform 13 which comprises three inertial sensors, and in particular a magnetometric sensor 13A, a gyroscopic sensor 13B and an accelerometer sensor 13C.

Analogously, on the helmet 12 there is a second inertial platform 14, also comprising a magnetometric sensor 14A, a gyroscopic sensor 14B and an accelerometer sensor 14C.

Even more in particular, in this example, the accelerometer and gyroscopic sensors each comprise a predetermined set of three detection directions (for example of Cartesian type) to determine the Cartesian components of acceleration and of angular velocity of the respect inertial platform in space. The magnetometric sensor is capable of detecting the Earth's magnetic axis and therefore of giving a basic spatial reference with respect to which the inertial parameters coming from the accelerometers and from the gyroscopes are calculated.

According to this configuration, each accelerometer sensor 13C-14C is preferably substantially provided with three accelerometers arranged with detection directions coincident with a set of three Cartesian coordinates; analogously, also each gyroscopic sensor 13B-14B is provided with three gyroscopes with detection directions coincident with a set of three reference coordinates. Further, in this example also each magnetometric sensor 13A-14A comprises three magnetometers arranged according to a predetermined set of three detection directions (for example of Cartesian type).

In the example being described, advantageously each inertial platform (or the components thereof) is of MEMS (Micro Electro Mechanical Systems) type, which makes use of the response to the accelerations (linear, including gravity) and to the circular motions of appropriate membranes integrated in electronic transducers.

In the example being described, appropriately, the MEMS gyroscopes used, make use of the Coriolis effect (in a reference system rotating at angular velocity $\omega$ a mass m in motion with velocity v is subjected to the force $F=-2m(\omega\times v)$).

The simplified geometry of a gyroscope of this type comprises a mass made to vibrate along an axis (direction of the velocity v); when the gyroscope rotates, the Coriolis force introduces a secondary vibration along the axis orthogonal to the axis of vibration: measuring the displacement of the mass in this direction the total angular velocity of the mass is obtained.

MEMS accelerometers instead make use of Newton's law for measurement. They are in particular composed of a test mass with elastic supporting arms. The transduction system of the displacement can, for example, be piezoelectric or capacitive.

Therefore, each inertial platform 13 and 14 has three sensors, each sensor being in practice itself composed of three "sub-sensors" (gyroscopes, accelerometers and magnetometers) arranged orthogonally to one another. The gyroscopes are sensitive to the rotations, the accelerometers are sensitive to the accelerations and also offer a reference to the set of three gyroscopes, i.e. the plane orthogonal to the direction of gravity, while the magnetometers are sensitive to the magnetic field and also offer a reference to the set of three gyroscopes, i.e. the plane orthogonal to the magnetic north of the Earth.

The aiming system 10 also comprises electronic means form managing and processing the information received from the inertial sensors described above, for example an electronic unit 15 physically arranged on the helmet/head display 12A, for example integrated or associated with the second MEMS inertial platform 14. According to the invention, this electronic unit is, among other things, designed to place in mutual relation the orientation and the position in space of the weapon 11 and of the display device 12 and to represent in the visor 12B, on the basis of said relations of orientation and of position, at least part of the firing trajectory of the weapon, i.e. the trajectory of the projectile fired from the weapon, as will be better described below.

It is understood that the system comprises data communication means between the weapon 11 and the display device 12, such as, preferably, a wireless communication system between the first inertial platform 13 and the electronic unit 15, and communication means (preferably of physical type, for example cables or conductive tracks) between the second inertial platform 14 and the same electronic unit 15.

Briefly summarizing the components of the system, this comprises

- movement sensor means on the rifle, which perceive both circular motions and linear motions of the weapon and sending means to an electronic processing unit on the helmet;
- movement sensor means on the helmet, which perceive both circular motions and linear motions of the helmet, i.e. of the head;
- a processing unit, preferably installed in the same mechanical part as the movement sensor means of the helmet, which acquire the data of the two sensor means (those from the weapon preferably via wireless channel), process the data and send to the HUD the commands for displacement of the aiming reticle (which in practice forms part of the firing trajectory of the weapon, i.e. the final part thereof) according to the movements perceived;
- an HUD, i.e. a visor integrated in the front part of the helmet, which, starting from the position and orientation data of the helmet and of the rifle, projects the aiming reticle following the displacement of the weapon with respect to the head, considering both the variation of orientation of the head and of the weapon in space, and the linear translation (variation of distance between the two bodies), i.e. the variation of relative position of the weapon and of the head.

The system is preferably installed on a helmet capable of protecting the soldier's face completely.

The head up display shows the data to the user, simultaneously showing the real scene and the superimposed information, among which the aiming reticle, which in practice is the end part of the line of fire, thus avoiding significant movements of the head or of the eyes, as occurs, for example, if a soldier requires to aim at the target to be shot at.

Therefore, due to the HUD, the operator can shoot aiming precisely at the target, while maintaining a tangible perception of the battlefield without any obstacles between the eyes and the outside world, as is instead the case with a conventional aiming scope. In particular, the aiming reticle appears on the visor of the helmet, in front of the eyes. To prevent eye fatigue caused by continuous change of focus (focusing—refocusing between real scene and superimposed data), in HUDs for aircraft, for example, the focus is infinite (infinity focusing), so as to allow the pilot to read the display without refocusing. Some experimental HUDs instead operate by writing the information directly on the user's retina.

Operation of the HUD in thus centered on projecting the image, in our case an aiming reticle, onto a clear glass optical element (combiner), as in FIG. 1.

The aiming reticle is none other than a visual aid for the user who has to shoot and ideally (unless there are corrections due to the scope or to the mechanical assembly of the weapon) it is aligned with the weapon, i.e. indicates a precise point toward which the projectile fired will be directed.

The head up display is well known in applications to vision systems associated with weapons and is typically composed of the following components:

- Combiner: the combiner is a screen (for example an optically corrected plastic lens), partially reflecting, but essentially transparent, which reflects the light projected by an image projection unit IPU. The light that reaches the eye is a combination of the light that passes through the lens and of the light reflected by the projector.
- Mobile Data Terminal (MDT): this unit communicates with a central processor to access the information it requires.
- Video Image Generator: this unit generates the video images based on characters for the information acquired through the MDT unit.
- Image Projection Unit—IPU: this unit acquires the video signal from the video image generator and projects the video images (in the present case, the aiming reticle) in the combiner. Currently, due to the new technologies developed in the field of micro-displays and of MEMS, this unit is based on a liquid crystal display (LCD), liquid crystal on silicon display (LCOS), or on digital micromirror devices (DMDs), organic light emitting diodes (OLED) and low intensity lasers (which project directly onto the retina).

Having stated this, it must be borne in mind that for operation in the case in hand, the HDU requires data coming from the electronic unit, i.e. the orientation and relative position data between helmet and weapon, which can be calculated using the inertial platforms described (the reticle will take into account the corrections to be made after a few test shots).

It must be noted how the use of movement sensors—both circular and linear—on weapon and helmet makes it possible to eliminate parallax errors (caused by the variable distance between head and weapon) which precede the shooting operation.

In order to operate, the aiming system also requires reference means adapted to define an initial orientation and an initial position in space for the weapon 11 and the display device 12 which must be known to the system in such a manner as to have initial data from which to carry out the variations in orientation and position detected by the sensors. For example, these reference means comprise a positioning area 16A between weapon 11 and display device 12 such that when the weapon is positioned on said display device in said positioning area 16A, the position and the relative orientation of the two parts are unequivocally determined and the system initializes determination of orientation and relative position of the two from the moment of this positioning. For example, the reference area 16A is implemented by a pocket 16A defined on the helmet inside which a counter-shaped part 16B of the weapon 11 is inserted, in such a manner that in coupling thereof the mutual orientation and the mutual position are unequivocally defined. Appropriately, a control can be present on this pocket (for example a push button), so that when the weapon 11 is coupled with the pocket 16A of the helmet, this control is necessarily activated (in the case of the push button, pressed by the weapon) and the system initializes the mutual position and orientation of the weapon and of the display device.

A simple example that briefly illustrates the operation of the system is as follows: a soldier on foot, with rifle held at the side and pointing to the front and with the head facing to the front, sees the aiming reticle (in fact it forms the final part of the firing trajectory of the weapon) on the visor 12B of the head up display in front of his/her face move clearly if the rifle is rotated to the right or left, up or down, with the same direction as the weapon. Instead, if the soldier holds the rifle still and rotates his/her head, the reticle will move in the opposite direction to the rotation. Finally, if the head or the rifle are translated and not rotated with respect to each other, displacement of the reticle takes place according to the description above, but in a much less perceptible manner. It must be noted, for example, how by rotating the weapon by 5° at 100 m, the point of impact is in actual fact 90 m outside the target, while if the weapon is translated by 50 cm with respect to the helmet, at 100 m the point of impact maintains a distance of 50 cm outside the target. Therefore, the distance increases the weight of the angular error, while the linear error remains constant (one of the innovative aspects of the present invention is that of considering relative translation of the display device and of the weapon as a result of determination of their linear translations measured by means of accelerometers).

To correctly display the firing point on the visor, the system uses particularly advantageous algorithms to process the parameters detected by the magnetometric, gyroscopic and accelerometer sensors. Hereinafter, a description will be provided on the basis of a detailed example of operation of the system.

Operation of the aiming system 10 can be divided into two steps: an initializing (or alignment) step of the system, in which the position and relative orientation in space of the weapon and of display device are determined, as described previously, and an aiming and firing step.

In both steps all the parameters provided by the two inertial platforms are permanently read, i.e. three acceleration components, three angular velocities, three magnetic field components for each of the two platforms, measured according to the directions of detection of the sensors, in this example arranged orthogonally to define a set of three Cartesian coordinates.

Hereunder reference will be made only to the inertial platform of the weapon, the description also relating to the inertial platform of the display device, substantially analogous.

Therefore, with $A_{mx}$, $A_{my}$, $A_{mz}$ reference will be made to the accelerations measured by the three accelerometers arranged orthogonally to one another, i.e. along a set of three Cartesian coordinates x, y, z and which are therefore the three Cartesian components of the acceleration to which the platform is subject; analogously $W_{mx}$, $W_{my}$, $W_{mz}$ indicate the components of the angular velocity of the platform measured by the three gyroscopes, and $H_x$, $H_y$ and $H_z$, the three magnetic field components measured by the magnetic sensor.

It must be noted that as only the relative position (and not the absolute position) is important, it is unnecessary to correct the magnetometer readings with the angle of magnetic declination and therefore the system can be transported to different parts of the world without requiring recalibration.

As stated, before the aiming system can be used, it must be initialized. This operation ensures that at the time t=0 the two platforms are located at a known mutual distance and angular position (otherwise it would not be possible to measure the initial linear distance without a GPS receiver). During this step the drifts of the gyroscopes and of the accelerometers (offset in the acceleration and angular velocity values which, with the two systems stopped, should be null, but which are instead perceived by the system) are measured and subtracted (naturally if present), i.e. cancelled, at the subsequent acquisitions. For initialization, as stated, the helmet is provided with a reference pocket 16A on which the corresponding part 16B on the weapon is positioned, with a predetermined orientation. Initialization of the system requires a few seconds, is started, for example, by pressure of the part 16B (or other appropriate part of the weapon) on the pocket 16A and can be repeated to "reset" the system in the case of need.

More schematically, this initialization step includes (the inertial platforms 13 and 14 are not moving with respect to each other):

- measurement of the drift of the gyroscopes, for example by means of an average of the values measured $W_{mx}$, $W_{my}$, $W_{mz}$ in successive readings (for example three);
- calculation of the gravity acceleration component on each of the three accelerometers appropriately filtered, measurement of the drift of the three accelerometers, by means of an average of the values measured $A_{mx}$, $A_{my}$, $A_{mz}$ in successive readings (for example three), having subtracted the gravity acceleration;
- setting of the initial position and velocity values for the two platforms.

The moment in which the weapon 11 is moved away from the helmet (separation from the reference pocket 16A), the inertial platforms 13 and 14 on the weapon 11 and on the helmet 12 respectively, measure their positions in space and consequently the mutual distance and the mutual orientation. Orientation is expressed by means of Tait-Bryan angles (a variant of Euler angles which, as known, describe the position of an XYZ reference system integral with a rigid body through a series of rotations starting from a fixed xyz reference system; the origin of the two reference systems coincides) also known as "roll", "pitch" and "heading" (or yaw), or according to convention in short as R , P and H.

Calculation of the orientation (i.e. of angles) starting from the angular velocity values measured by the gyroscopes takes place by integrating the velocity once, while the position is calculated by integrating the acceleration measured by the accelerometers twice.

The integration step of the angular velocity and acceleration data must be implemented correcting the effect caused by gravity acceleration and centripetal acceleration, which would falsify the values, as better described below.

Figure 2:
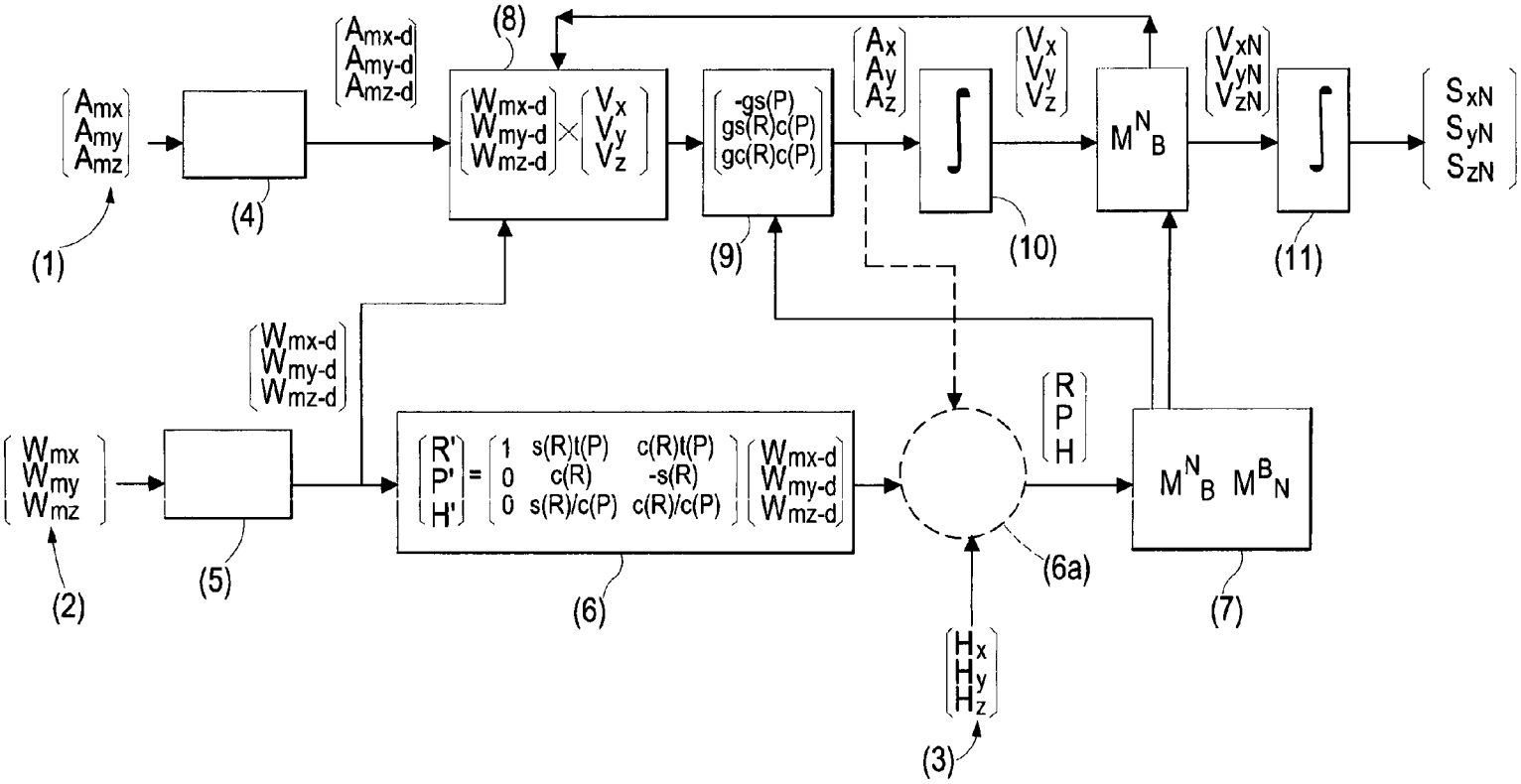
FIG. 2 represents a flow chart of the steps of the algorithm which, given the inputs of the sensors of the sets of three according to the invention, gives as output the positioning and the relative orientation of the weapon and of the display device.

FIG. 2 shows a diagram of the advantageous algorithm used by the system, which takes account of the description above, to identify orientation and position of the inertial platforms associated with the weapon and with the helmet from which it is possible to calculate the variation of position between the two bodies which is translated on the visor so that the firing point of the weapon is always visible thereon, regardless of how weapon and user's head are moved.

The steps of this algorithm are as follows (the steps refer to the orientation and position measurement of the weapon, the steps relating to the display device being substantially identical).

The processing unit 15 receives the linear acceleration data (point (1) in FIG. 2) $A_{mx}$, $A_{my}$ and $A_{mz}$ measured by the accelerometers 13C relating to the system integral with the weapon 11, and (point (2)) the angular velocities $W_{mx}$, $W_{my}$, $W_{mz}$, measured by the gyroscopes 13B and the magnetic field measurements $H_x$, $H_y$, $H_z$ (point (3)) supplied by the magnetometer 13A. The processing unit receives analogous data from the inertial platform 14 of the display device 12.

The readings of the accelerometers 13C are corrected (point (4)), subtracting the drift that was calculated in the initialization step, as described previously, obtaining refined values $A_{mx\text{-}d}$, $A_{my\text{-}d}$, $A_{mz\text{-}d}$.

Analogously, the readings of the gyroscopes 13B are corrected (point (5)), subtracting the drift that was calculated in the initialization step, as described previously, obtaining refined values $W_{mx\text{-}d}$, $W_{my\text{-}d}$, $W_{mz\text{-}d}$.

To obtain the value of the Tait-Bryan (or Euler) angles R, P and H that define the orientation in space of the inertial platform 13, it is necessary to integrate, for example as in point (6*a*), the derivatives R', P' and H' of these angles, calculated as follows (point (6)).

$$\begin{vmatrix} R' \\ P' \\ H' \end{vmatrix} = \begin{vmatrix} 1 & s(R)t(P) & c(R)t(P) \\ 0 & c(R) & -s(R) \\ 0 & s(R)/c(P) & c(R)/c(P) \end{vmatrix} \begin{vmatrix} W_{mx\text{-}d} \\ W_{my\text{-}d} \\ W_{mz\text{-}d} \end{vmatrix}$$

where s(−) and c(−) indicate the sine and cosine functions (hereunder t(−) indicates the tangent function).

The values of R, P and H will also be used to determine the conversion matrices between the two reference systems, the one integral with the inertial platform and the Earth reference system, and in particular the NED system (i.e. the "North East" Down reference system integral with the Earth).

The conversion matrix between platform system and NED system is:

$$M_N^B = \begin{vmatrix} c(P)c(H) & c(P)s(H) & -s(P) \\ s(R)s(P)c(H) & s(R)s(P)s(H)+c(R)c(H) & s(R)/c(P) \\ c(R)s(P)c(H)+s(R)s(H) & c(R)s(P)s(H) & c(R)/c(P) \end{vmatrix}$$

wherein P, R and H are respectively the Pitch, Roll and Heading value; the inverse matrix $M_B^N$ can also be obtained from this matrix for the inverse transformation.

The expression of the conversion matrix between platform and NED reference (Earth reference system) and also the expression of the matrix that enables the derivatives of the angles of orientation to be obtained from readings of the gyroscopes ($W_{mx}$, $W_{my}$, $W_{mz}$) (point (6)) is well known in the literature, for example in "Grewal, M. S., Weill, L. R., and Andrews, A. P., Global Positioning Systems, Inertial Navigation, and Integration, John Wiley and Sons, New York, 2001".

The gravity acceleration component (point (8)) and the centripetal acceleration (point (9)) are subtracted from the datum supplied by the accelerometers ($A_{mx}$, $A_{my}$, $A_{mz}$). That is, the following formulae are applied to obtain the corrected values $A_x$, $A_y$, $A_z$ knowing the raw values $A_{mi}$, i.e. those supplied directly by the accelerometers:

$$A_x = A_{mx\text{-}d} - (W_{mx\text{-}d}V_z - W_{mz\text{-}d}V_y) - gs(P)$$

$$A_y = A_{my\text{-}d} - (W_{mz\text{-}d}V_x - W_{mx\text{-}d}V_z) - gs(R)c(P)$$

$$A_z = A_{mz\text{-}d} - (W_{mx\text{-}d}V_y - W_{my\text{-}d}V_x) - gc(R)c(P)$$

where $V_x$, $V_y$, $V_z$, are the velocity values obtained from integration of the acceleration point (10), g indicates the gravity acceleration and P and R respectively indicate the Pitch and Roll value. At the first step of the algorithm, the velocities $V_x$, $V_y$, $V_z$ are not yet available, as they are obtained from integration of the same accelerations that are being processed, and therefore must be appropriately initialized at zero. In fact, the initial relative velocity between the two platforms (the only motions of interest are in fact those that are relative) is equal to zero.

The preceding relations are easily obtainable. By way of example, let us consider the first: the projection of gravity on the axis x of the platform and the component along the axis x of the vector product between the angular velocity and linear velocity vector, both expressed in the reference system of the platform, are subtracted from the raw acceleration $A_{mx-d}$ along the axis x.

The accelerations $A_x$, $A_y$, $A_z$ thus refined are integrated (point (10)), as already mentioned, to obtain the velocity components $V_x$, $V_y$, $V_z$. These latter are reproduced in the NED system by means of the aforesaid conversion matrix $M_B^N$, thus obtaining the velocity components in the earth system $V_{xN}$, $V_{yN}$, $V_{zN}$. Moreover, these velocities are further integrated (point (11)) to finally reach the position in space of the inertial platform ($S_{xN}$, $S_{yN}$, $S_{zN}$).

As the accelerations in play are of limited size, the orientation can also be obtained by measuring the projection of the gravity acceleration on the axes of the accelerometer and measuring the Heading angle using the magnetic field sensor. The equations to obtain the Tait-Bryan (Euler) angles with the accelerometer and magnetometer readings are the following:

$$P=s^{-1}(A_x)$$

$$R=t^{-1}(A_y/A_z)$$

$$H=t^{-1}(H_y/H_x)$$

For proof of these relations reference should be made to specialized texts (e.g. "Grewal, M. S., Weill, L. R., and Andrews, A. P., Global Positioning Systems, Inertial Navigation, and Integration, John Wiley and Sons, New York, 2001" and others).

Therefore, the Tait-Bryan (Euler) angles (P,R,H), which describe the orientation in space of a rigid body, are obtained in two distinct ways (integration of the gyroscopes on the one hand and use of accelerometers and magnetometers on the other).

Appropriately, in the algorithm of the invention, the two data are merged in an iterative sub-algorithm hereinafter called "sensor fusion" algorithm, to obtain an even more precise result using the block diagram indicated in FIG. 3. This image has different nomenclature: $P_{acc}$, $R_{acc}$, $H_{acc}$ refer to the second method of calculating the Tait-Bryan (Euler) angles, i.e. with the aid of accelerometers and magnetometers, while a tan 2 indicates the function that calculates the arc tangent in the fourth quadrant.

Substantially, the algorithm functions in the same way for R, P and H; therefore, the single case relating to the Pitch (P) is described below. In the first step the algorithm subtracts from the derivative of the Pitch, calculated in point (6) through the gyroscopes, a parameter k (the value of which is appropriately initialized, but which in theory could be any, accepting a few extra seconds delay in the reaching steady state of the attitude data), after which it is integrated and output as final Pitch value. Instead, starting from the second step, the value of k which is added to/subtracted from the derivative of the Pitch varies according to the difference between $P_{gyro}$ (i.e. calculated starting from the measurement at the gyroscopes) and $P_{acc}$ (i.e. calculated starting from the measurement at the accelerometers). In this way, this difference is gradually leveled out and also changes the output Pitch value (as the same integrand varies, when k varies).

Figure 3:
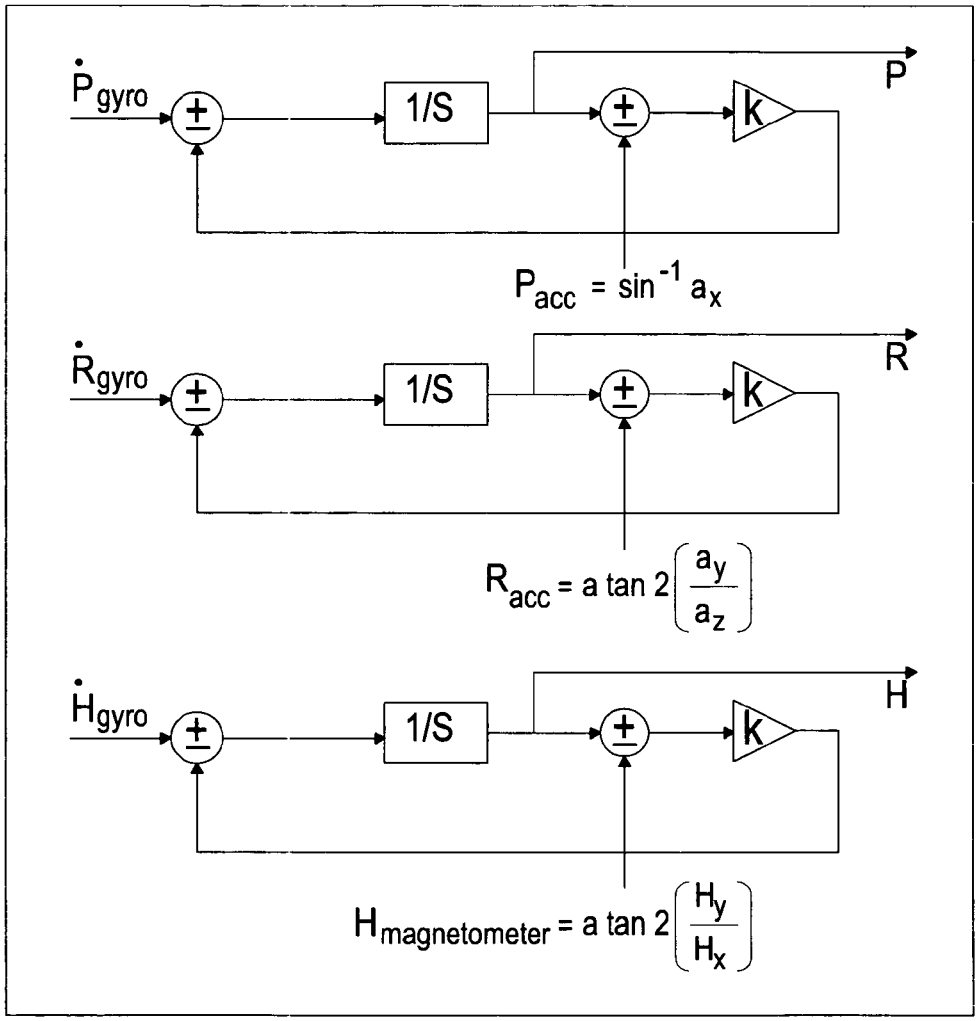
FIG. 3 represents a part of the algorithm of FIG. 2, showing a sub-algorithm relating to calculation of the angles of orientation relating to the weapon and to the display device according to the invention.

This sub-algorithm is defined "sensor fusion" as it merges the data coming from three different types of sensor, the gyroscopes, the accelerometers and the magnetometers (FIG. 3). This sub-algorithm substantially compares the values of R, P, H calculated through the gyroscopes (or, more precisely, the variations of these angles, $\dot{R}$,$\dot{P}$,$\dot{H}$, see point (6)) with those calculated by the accelerometers ($R_{acc}$,$P_{acc}$) and the magnetometers ($H_{magnetometer}$). The first method (point (6)) makes use of the values of the gyroscopes after having appropriately subtracted the drifts ($W_{mx-d}$, $W_{my-d}$, $W_{mz-d}$) and of the Tait-Bryan (Euler) angles calculated in the preceding step (and therefore appropriately initialized for the first step) to obtain the variations of the three angles of interest which, integrated, provide the angles of R, P, H. Instead, in the second method (point (6A) of FIG. 2 and FIG. 3) with the hypothesis of low accelerations in play, with regard to calculation of Pitch and Roll the appropriately corrected accelerometers are used (at the output of point (9), i.e. $A_x$, $A_y$ and $A_z$), while the magnetometers are instead used to calculate Heading. At this point, the parameter k of FIG. 3 is used to "weigh" the two methods, i.e. to give more relevance to one calculation of the attitude angles with respect to the other. The smaller the value of k is, the less weight the calculation performed with the accelerometers will have in the measurement, and vice versa. The value of the parameter will depend on the specific application.

As stated, the algorithm of the invention calculates, on the basis of the acceleration, angular velocity and magnetic angle values, the position in space of the inertial platforms ($S_{xN}$, $S_{yN}$, $S_{zN}$) of the weapon and of the display device. More in particular, the measurement of the orientation of the weapon and of the helmet and the mutual distance given by the difference of the components of the position vector are provided at the output of the algorithm.

Therefore, the data sent at the output of the algorithm are:

$$P_{relative}=P_{helmet}-P_{weapon}$$

$$R_{relative}=R_{helmet}-R_{weapon}$$

$$H_{relative}=H_{hemlet}-H_{weapon}$$

$$S_{xN}_{relative}=S_{xN}_{helmet}-S_{xN}_{weapon}$$

$$S_{yN}_{relative}=S_{yN}_{helmet}-S_{yN}_{weapon}$$

$$S_{zN}_{relative}=S_{zN}_{helmet}-S_{zN}_{weapon}$$

The mutual position of the two platforms (relative angle and distance) is used to project in a three-dimensional manner the position of the line of fire on the visor 12B of the head up display 12A.

Given the accuracy of current MEMS systems, and the initialization procedure, the aiming system proposed is capable of allowing a standard man target to be hit at 100 m. With the current technology, the inertial platform and the algorithms developed can reach an accuracy of 0.2°; by combining the measurement uncertainty of the two inertial platforms, an accuracy of 0.3° is obtained, equivalent to around 6 mrad, i.e. a tolerance of 50 cm at a distance of 100 m. In the case in which the weapon is used in "almost static" mode, i.e. without sudden and continual movements of the helmet and of the rifle, the accuracy can reach 0.02°, i.e. a tolerance of 10 cm at 100 m, therefore better than that determined by the natural dispersion of the weapon. It is understood that with normal advance in the precision of the technologies used, this accuracy is destined to increase further.

It is evident how the aiming system described above achieves the set objects. In fact, the proposed system makes it possible to aim the fire of an assault weapon at a target without the need to place the eye, and therefore the face, on the line of sight.

A particularly advantageous aspect of this system is that the soldier's head, face, neck and throat can be protected at all times using a full face helmet with anti-shrapnel visor, so as to reduce trauma in an area that is currently the most vulnerable to any form of attack.

This system enables the elimination of any type of E/O sensor (both in the visible and the infrared band), eyepieces, objective lenses, keypads from the weapon, greatly reducing its weight and leaving only a mechanism for the inertial platform and the electronics for composition of the partial deviations (of the rifle) and transmission thereof. It must be noted how the system can, in a variant, be equipped on the helmet with a sensor for nocturnal movement: the reticle would in this case appear not on the head up display, but on the image generated by the indirect display system positioned on the helmet and reproduced on a standard eyepiece.

A fundamental aspect of the present aiming system is that of detecting and therefore of correcting the parallax error that arises in the case of deferred shot. In fact, accelerometers are used for the first time to enable correction of a parallax error.

It is understood that the drawing only shows possible non-limiting embodiments of the invention, which can vary in forms and arrangements without however departing from the scope of the concept on which the invention is based. Any reference numerals in the appended claims are provided purely to facilitate the reading thereof, in the light of the above description and accompanying drawings, and do not in any way limit the scope of protection.

The invention claimed is:

1. An aiming system for portable weapons comprising:

a first pair of inertial sensors and a second pair of inertial sensors, said first part of inertial sensors and said second pair of inertial sensors to be arranged respectively on a portable weapon defining a firing trajectory, and on a display device to be worn on a head of a user comprising a visor that can be viewed by the user, said first pair of inertial sensors comprising first inertial sensors adapted to detect an orientation in space and said second pair of inertial sensors comprising second inertial sensors adapted to detect an orientation of a terrestrial magnetic field, said first pair of inertial sensors and said second pair of inertial sensors being adapted to determine, in cooperation with reference means adapted to define at least one initial orientation for said weapon and said display device in space, a relative orientation in space for the weapon and the display device;

an electronic means for managing information received from said first pair of inertial sensors and said second pair of inertial sensors and adapted to place in mutual relation the orientation in space of said weapon and of said display device and to represent in said visor, on a basis of said orientation relation, at least part of the firing trajectory of the weapon;

a third pair of inertial sensors respectively arranged on said weapon and on said display device, said third pair of inertial sensors comprising third inertial sensors adapted to determine a linear displacement in space of said weapon and of said display device, said electronic means for managing information being adapted to place in mutual relation positions in space of said weapon and of said display device and to represent in said visor at least part of the firing trajectory of the weapon both on a basis of said position relation, and on the basis of said orientation relation.

2. A system according to claim 1, wherein said third inertial sensors are accelerometers adapted to determine, in cooperation with said electronic managing means, a value of translations of said weapon and of said display device associated with the head of the user for using a translation value in a calculation and representation of said at least part of the firing trajectory of the weapon in the visor.

3. A system according to claim 1, wherein said first pair of inertial sensors, said second pair of inertial sensors and said third pair of inertial sensors are arranged on two MEMS-type inertial platforms.

4. A system according to claim 1, wherein on said portable weapon and on said display device are three inertial sensors said three inertial sensors comprising a magneto-metric sensor, a gyroscopic sensor and an accelerometer sensor.

5. A system according to claim 4, wherein said gyroscopic sensor and said accelerometer sensor comprise sets of three detection directions to determine Cartesian components of an angular velocity and of an acceleration in space.

6. A system according to claim 1, wherein one or more of said gyroscopic sensors and said accelerometer are formed by three "sub-sensors" respectively in a form of gyroscopes and linear accelerometers, arranged orthogonal to one another, said gyroscopes being sensitive to rotations, said accelerometers being sensitive to accelerations and form a reference to the set of three gyroscopes, said magnetometric sensor forming a reference to the set of three gyroscopes.

7. A system according to claim 1, wherein said electronic means for managing information coming from the inertial sensors comprises an electronic unit physically associated with the display device, said electronic unit being designed to place in mutual relation the orientation and the position in space of the weapon and of the display device and to represent in the visor, on the basis of said relations of orientation and of position, at least part of the firing trajectory of the weapon.

8. A system according to claim 1, wherein said display device is associated with a helmet.

9. A system according to claim 1, further comprising data communication means, of wireless type, between sensor means of said weapon and said electronic managing means.

10. A system according to claim 1, further comprising reference means for defining an orientation and an initial position in space for the weapon and the display device (12) which must be known to the system in such a manner as to have initial data from which to carry out variations in orientation and position detected by the sensors useful for projection in the visor of said at least one firing trajectory.

11. A system according to claim 10, wherein said reference means comprises a positioning area between the weapon and the display device such that when the weapon is positioned on said display device in said positioning area, the position and the relative orientation of the weapon and the display device are unequivocally determined.

12. A system according to claim 11, wherein said reference area is implemented by a pocket defined in a helmet inside which a counter-shaped part of the weapon is inserted, in such a manner that in coupling thereof a mutual orientation and a mutual position are unequivocally defined, wherein a control is present on said pocket such that when the weapon is coupled with said pocket, said control being necessarily activated and the system initializes the mutual position and orientation of the weapon and of the display device.

13. A system according to claim 1, further comprising an initialization step in which the position and relative orientation in space of the weapon and of the display device are defined, so that at a time t=0, the weapon and the display device are at a known mutual distance and angular position, said initialization step comprising:

measurement of a drift of the gyroscopes;

calculation of a gravity acceleration component on each of three accelerometers appropriately filtered and measurement of drift of the three accelerometers, having subtracted the gravity acceleration;

setting of initial position and velocity values of the weapon and of the display device.

14. A system according to claim 1, wherein said electronic managing means calculates, by a specific algorithm, on the basis of values of acceleration, angular velocity and magnetic angle, the position in space of the weapon and of the display device, an output of said specific algorithm providing a relative distance and relative orientation between the weapon and the display device by means of difference of Cartesian components of position in an Earth reference system and by means of difference of respective Pitch, Roll and Heading angles.

15. A system according to claim 1, wherein determination of one or more of the position of said weapon and of said display device is implemented by integrating twice an acceleration measured by an acceleration sensor.

16. A system according to claim 15, wherein before the integrating, said acceleration measured by said acceleration sensor is corrected by subtracting one or more of gravity acceleration and centripetal force.

17. A system according to claim 16, wherein before correction by means of subtraction of one or more of the gravity acceleration and of the centripetal acceleration, said acceleration measured by said acceleration sensor is corrected by means of subtraction of a drift effect measured in an initialization step.

18. A system according to claim 15, wherein the centripetal acceleration is calculated using angular velocity data measured by a gyroscopic sensor after having subtracted a value of the drift calculated in the initialization step.

19. A system according to claim 1, wherein determination of Pitch, Roll and Heading angles defining the orientation of one or more of said weapon and of said display device is implemented starting from values of angular velocity measured by a gyroscopic sensor and after having subtracted a value of drift calculated in an initialization step.

20. A system according to claim 1, wherein determination of Pitch, Roll and Heading angles defining the orientation of one or more of said weapon and of said display device can be implemented by means of operations performed on the following relations $$\begin{vmatrix} R' \\ P' \\ H' \end{vmatrix} = \begin{vmatrix} 1 & s(R)t(P) & c(R)t(P) \\ 0 & c(R) & -s(R) \\ 0 & s(R)/c(P) & c(R)/c(P) \end{vmatrix} \begin{vmatrix} W_{mx\text{-}d} \\ W_{my\text{-}d} \\ W_{mz\text{-}d} \end{vmatrix}.$$

21. A system according to claim 1, wherein determination of Pitch, Roll and Heading angles defining the orientation of one or more of said weapon and of said display device can be implemented by means of the following relations, where $A_{mx}$, $A_{my}$ and $A_{mz}$ are components along orthogonal axes x, y, z and $H_x$, $H_y$ components of the terrestrial magnetic field measured by a magnetometer along the axes x and y: $P=s^{-1}(A_{mx})$, $R=t^{-1}(A_{my}/A_{mz})$, $H=t^{-1}(H_y/H_x)$.

22. A system according to claim 20, wherein said determination of the Pitch, Roll and Heading angles defining the orientation of one or more of said weapon and of said display device is implemented by means of an algorithm, called sensor fusion, adapted to substantially compare values of variations $\dot{R}$, $\dot{P}$, $\dot{H}$ of the angles R, P, H, calculated through gyroscopic sensors, with the values of R, P, H calculated with relations, starting from values measured by accelerometer sensors.

23. A system according to claim 22, wherein determination of the Pitch, Roll and Heading angles takes place iteratively, at a first step the algorithm subtracts from the Pitch/Roll/Heading derivative calculated, a parameter k, a value of which is appropriately initialized, after which the Pitch/Roll/Heading derivative with the parameter k subtracted is integrated and provided as output as a final Pitch/Roll/Heading value, instead, starting from a second step, the value of k which is one of added to and subtracted from the Pitch/Roll/Heading derivative, varies according to a difference between $P_{gyro}$, calculated starting from a measurement at gyroscopes, and $P_{acc}$, calculated starting from measurement at accelerometers, in such a manner that said difference is reduced iteratively, simultaneously changing the Pitch/Roll/Heading value.

* * * * *